US010132248B2

(12) United States Patent
Son et al.

(10) Patent No.: US 10,132,248 B2
(45) Date of Patent: Nov. 20, 2018

(54) CONTINUOUS VARIABLE VALVE DURATION APPARATUS AND ENGINE PROVIDED WITH THE SAME

(71) Applicant: Hyundai Motor Company, Seoul (KR)

(72) Inventors: You Sang Son, Suwon-si (KR); Kyoung Pyo Ha, Seongnam-si (KR); Back Sik Kim, Osan-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 181 days.

(21) Appl. No.: 15/366,157

(22) Filed: Dec. 1, 2016

(65) Prior Publication Data

US 2017/0284311 A1 Oct. 5, 2017

(30) Foreign Application Priority Data

Mar. 31, 2016 (KR) ..... 10-2016-0039401

(51) Int. Cl.

| | |
|---|---|
| ***F01L 1/34*** | (2006.01) |
| ***F02D 13/02*** | (2006.01) |
| ***F01L 1/053*** | (2006.01) |
| ***F01L 13/00*** | (2006.01) |
| ***F01M 9/10*** | (2006.01) |
| ***F01M 11/02*** | (2006.01) |

(52) U.S. Cl.

CPC ..... *F02D 13/0207* (2013.01); *F01L 1/0532* (2013.01); *F01L 13/0015* (2013.01); *F01M 9/10* (2013.01); *F01M 9/102* (2013.01); *F01M 9/109* (2013.01); *F01M 11/02* (2013.01); *F01M 2011/026* (2013.01)

(58) Field of Classification Search

CPC ..... F01L 1/0532; F01L 13/0015; F01M 9/10; F01M 9/109; F01M 9/102; F01M 11/02; F01M 2011/026; F02D 13/0207

See application file for complete search history.

(56) References Cited

U.S. PATENT DOCUMENTS

| | | | | |
|---|---|---|---|---|
| 5,924,334 | A | 7/1999 | Hara et al. | |
| 2002/0092488 | A1* | 7/2002 | Aoyama ..... | F01L 13/0021 123/90.16 |

FOREIGN PATENT DOCUMENTS

| | | | |
|---|---|---|---|
| EP | 2 322 771 | A1 | 5/2011 |
| JP | 06-185321 | A | 7/1994 |
| JP | 09-041924 | A | 2/1997 |

(Continued)

*Primary Examiner* — Zelalem Eshete

(74) *Attorney, Agent, or Firm* — Morgan, Lewis & Bockius LLP

(57) ABSTRACT

A continuous variable valve duration apparatus may include a camshaft, a cam device, of which the camshaft is inserted thereto, of which a phase angle with respect to the camshaft is variable, and the cam device on which a cam key is formed, an inside bracket transmitting rotation of the camshaft to the cam device and on which a first slide opening and a second sliding opening are formed respectively, a slider housing in which the inside bracket is rotatably inserted and of which relative position with respect to the camshaft is variable, a controller selectively changing the relative position of the slider housing, a cam pin of which a cam key opening for the cam key to be slidably inserted thereto is formed and slidably inserted into the second sliding opening and a slider pin rotatably inserted into the first sliding opening and slidably inserted into the camshaft.

21 Claims, 9 Drawing Sheets

(56) References Cited

FOREIGN PATENT DOCUMENTS

| | | | |
|---|---|---|---|
| JP | 4259512 | B2 | 4/2009 |
| JP | 5582195 | B2 | 9/2014 |
| KR | 10-1326818 | B1 | 11/2013 |

* cited by examiner

CONTINUOUS VARIABLE VALVE DURATION APPARATUS AND ENGINE PROVIDED WITH THE SAME

CROSS-REFERENCE TO RELATED APPLICATION

The present application claims priority to Korean Patent Application No. 10-2016-0039401 filed on Mar. 31, 2016, the entire contents of which is incorporated herein for all purposes by this reference.

BACKGROUND OF THE INVENTION

Field of the Invention

The present invention relates to a continuous variable valve duration apparatus and an engine provided with the same. More particularly, the present invention relates to a continuous variable valve duration apparatus an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directly providing a continuous variable valve duration apparatus and an engine provided with the same which may vary opening duration of a valve according to operation conditions of an engine, with a simple construction.

A continuous variable valve duration apparatus according to an exemplary embodiment of the present invention may include a camshaft, a cam device on which a cam is formed, of which the camshaft is inserted thereto, of which a relative phase angle with respect to the camshaft is variable, and the cam device on which a cam key is formed, an inside bracket transmitting rotation of the camshaft to the cam device and on which a first slide opening and a second sliding opening are formed respectively, a slider housing in which the inside bracket is rotatably inserted and of which relative position with respect to the camshaft is variable, a controller selectively changing the relative position of the slider housing, a cam pin of which a cam key slot for the cam key to be slidably inserted thereto is formed and slidably inserted into the second sliding hole and a slider pin rotatably inserted into the first sliding hole and slidably inserted into the camshaft.

The slider pin may include a pin body slidably inserted into the camshaft and a pin head rotatably inserted into the first sliding hole, wherein the pin body and the pin head may be integrally or monolithically formed.

A camshaft oil hole may be formed in the camshaft along a longitudinal direction thereof, a body oil hole may be formed in the pin body and configured to fluidically-communicate with the camshaft oil hole and an oil groove may be formed in the pin head and configured to fluidically-communicate with the body oil hole.

The cam device may include a first cam portion disposed corresponding to a first cylinder and a second cam portion disposed corresponding to a second cylinder adjacent to the first cylinder, and the inside bracket may include first and second inside brackets configured to transmit rotation of the camshaft to the first and second cam portions respectively.

The continuous variable valve duration apparatus may further include a bearing disposed within the lifter and is supports the first and the second bracket.

The first inside bracket and the second inside bracket may be connected to each other.

The cam device may include a first, a second, a third and a fourth cam portion disposed corresponding cylinders, the inside bracket may include a first, a second, a third and a fourth inside bracket configured to transmit rotation of the camshaft to the first, the second, the third and the fourth cam portions respectively, and the slider housing may include a first slider housing in which the first and the second inside bracket are rotatable inserted and a second slider housing in which the third and the fourth inside bracket are rotatable inserted.

The continuous variable valve duration apparatus may further include double row bearings disposed within the first and the second slider housing respectively for rotatably supporting the first, the second, the third and the fourth inside bracket.

The first inside bracket and the second inside bracket may be connected to each other, and the third inside bracket and the fourth inside bracket may be connected to each other.

An engine according to an exemplary embodiment of the present invention may include a camshaft, a cam device on which a cam is formed, of which the camshaft is inserted thereto, of which a relative phase angle with respect to the camshaft is variable, and the cam device on which a cam key is formed, an inside bracket transmitting rotation of the camshaft to the cam device and on which a first slide opening and a second sliding opening are formed respectively, a slider housing in which the inside bracket is rotatably inserted and of which relative position with respect to the camshaft is variable, a controller selectively changing the relative position of the slider housing, a cam pin of which a cam key slot for the cam key to be slidably inserted thereto is formed and slidably inserted into the second sliding hole and a slider pin rotatably inserted into the first sliding hole and slidably inserted into the camshaft.

The slider pin may include a pin body slidably inserted into the camshaft and a pin head rotatably inserted into the first sliding hole, wherein the pin body and the pin head may be integrally or monolithically formed.

A camshaft oil hole may be formed in the camshaft along a longitudinal direction thereof, a body oil hole may be formed in the pin body and configured to fluidically-communicate with the camshaft oil hole and an oil groove may be formed in the pin head and configured to fluidically-communicate with the body oil hole.

The cam device may include a first cam portion disposed corresponding to a first cylinder and a second cam portion disposed corresponding to a second cylinder adjacent to the first cylinder, and the inside bracket may include first and second inside brackets configured to transmit The engine may further include a bearing disposed within the lifter and is supports the first and the second bracket.

The first inside bracket and the second inside bracket may be connected to each other.

The cam device may include a first, a second, a third and a fourth cam portion disposed corresponding cylinders, the inside bracket may include a first, a second, a third and a fourth inside bracket configured to transmit rotation of the camshaft to the first, the second, the third and the fourth cam portions respectively, and the slider housing may include a first slider housing in which the first and the second inside bracket are rotatable inserted and a second slider housing in which the third and the fourth inside bracket are rotatable inserted.

The engine may further include double row bearings disposed within the first and the second slider housing respectively for rotatably supporting the first, the second, the third and the fourth inside bracket.

The first inside bracket and the second inside bracket may be connected to each other, and the third inside bracket and the fourth inside bracket may be connected to each other.

The engine may further include a support bracket connecting the first slider housing and the second slider housing and on which a guide hole is formed, a cam cap rotatably supporting the camshaft and a guide rod mounted to the cam cap and inserted into the guide hole for guiding movement of the support bracket.

A control slot may be formed at the first and second slider housing respectively, and the controller may include an eccentric control shaft inserted into the control slots and a control motor rotating the eccentric control shaft for controlling a relative position of the sliding housing.

A shaft hole may be formed on each cam cap for the eccentric control shaft to be inserted therein.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
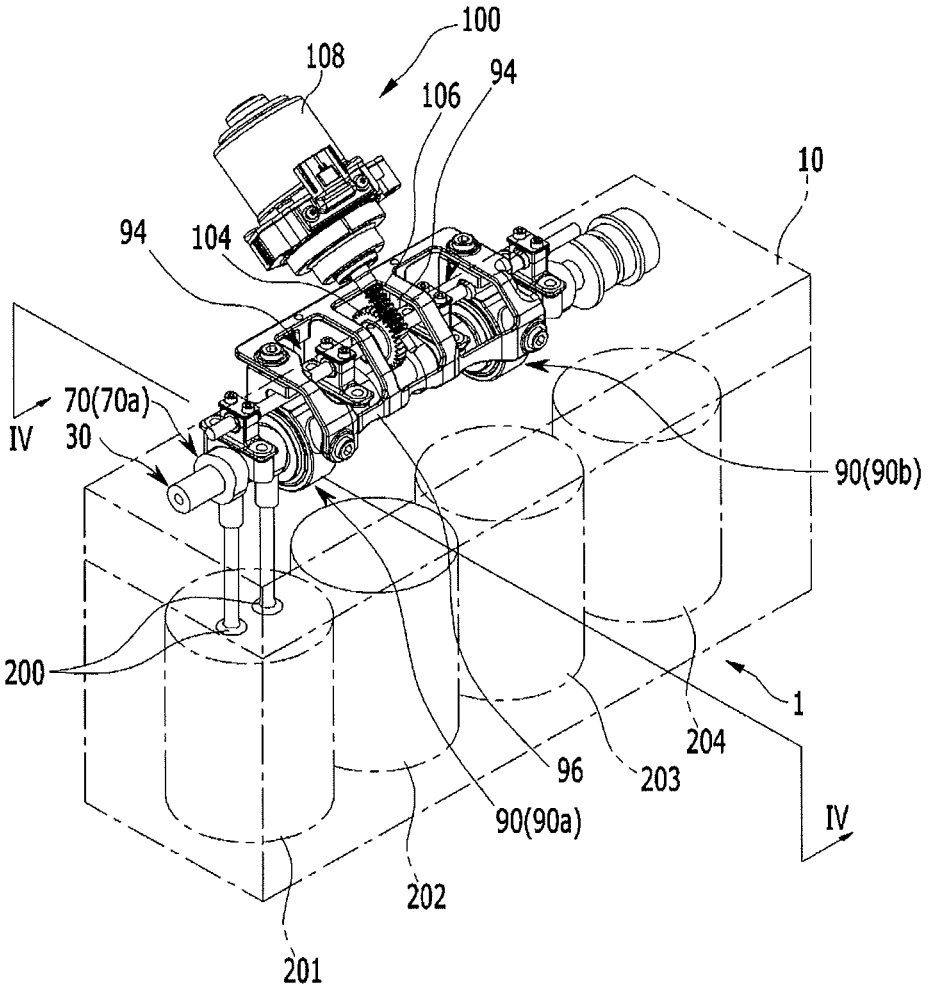
FIG. 1 is a perspective view of an engine provided with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
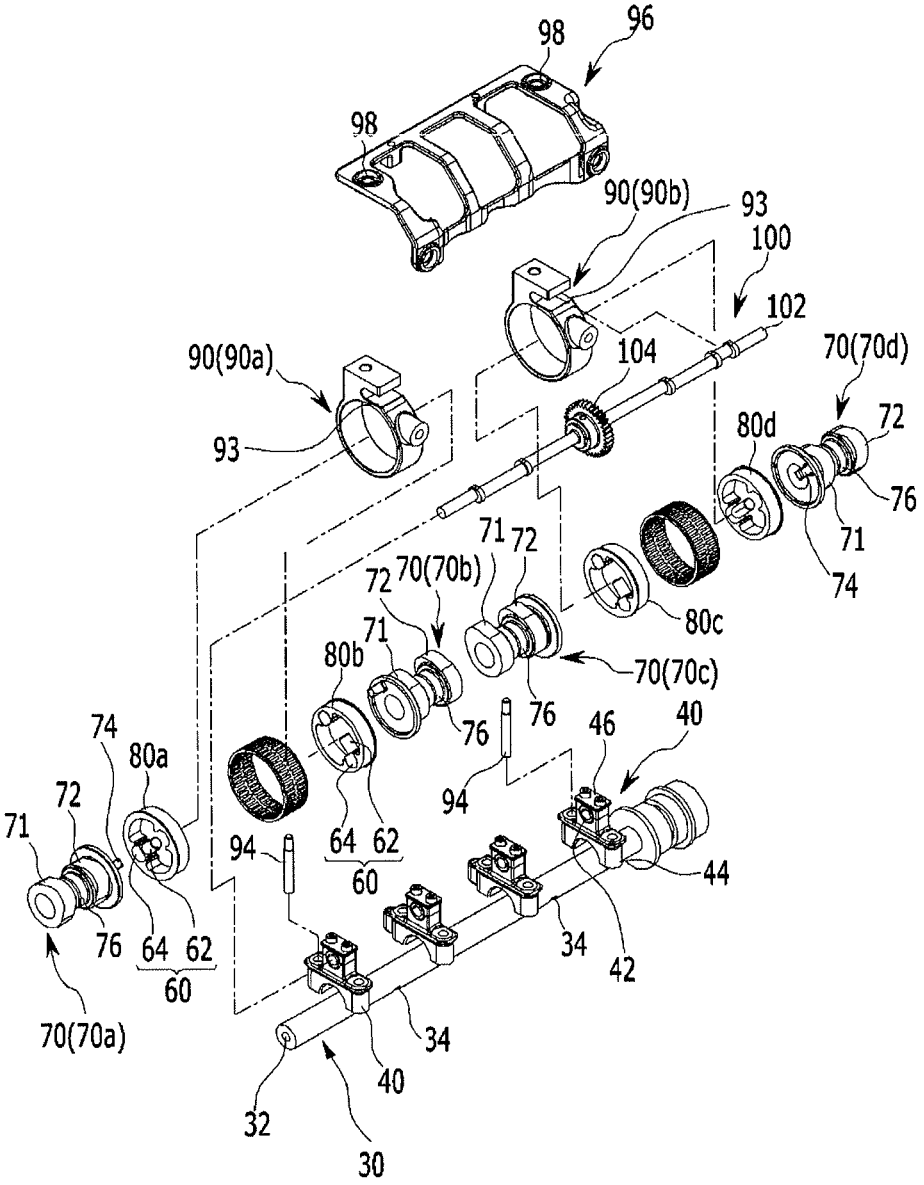
FIG. 2 is an exploded perspective view of a continuous variable valve duration apparatus according to an exemplary embodiment of the present invention.

FIG. 1 is a perspective view of an engine provided with a continuous variable valve duration apparatus according to an exemplary embodiment of the present invention and FIG. 2 is an exploded perspective view of a continuous variable valve duration apparatus according to an exemplary embodiment of the present invention.

Figure 3:
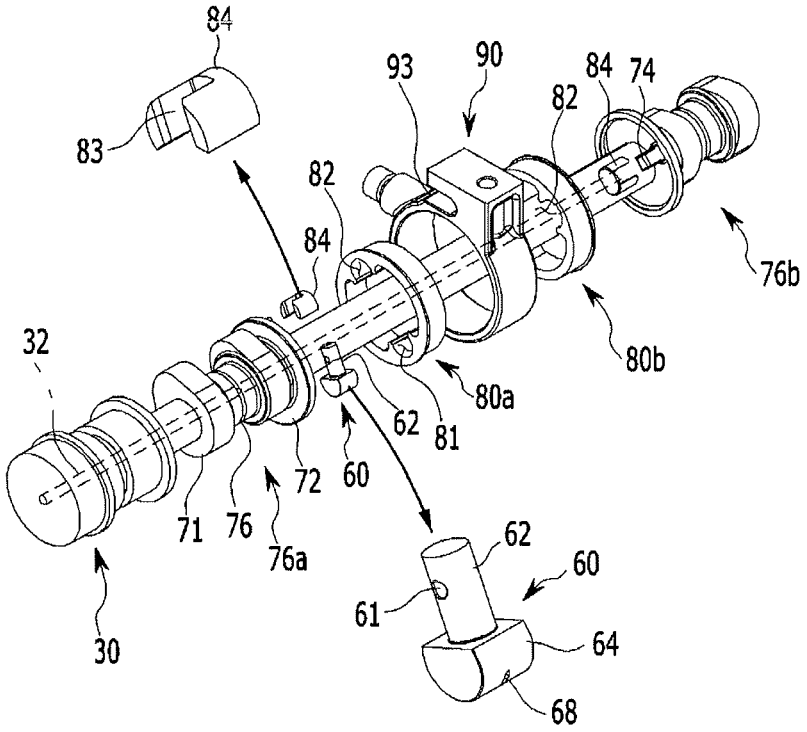
FIG. 3 is a partial exploded perspective view of a continuous variable valve duration apparatus according to an exemplary embodiment of the present invention.
Figure 4:
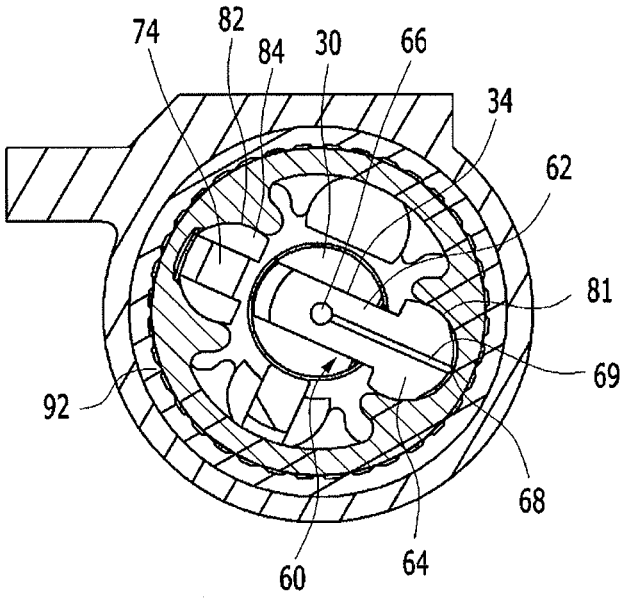
FIG. 4 is a cross-sectional view along line IV-IV of FIG. 1.
Figure 5:
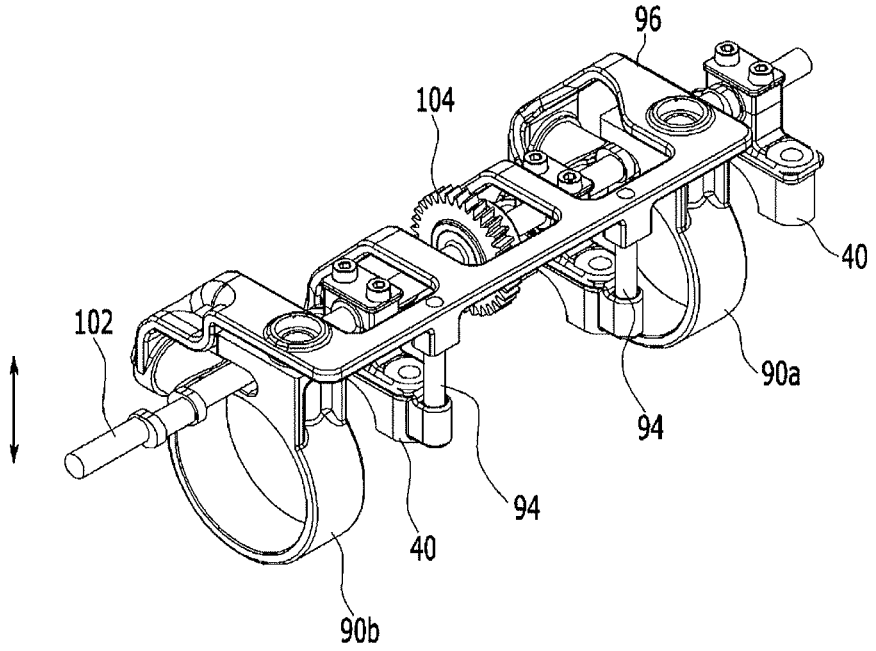
FIG. 5 is a partial perspective view of an engine provided with a continuous variable valve duration apparatus according to an exemplary embodiment of the present invention.

FIG. 3 is a partial exploded perspective view of a continuous variable valve duration apparatus according to an exemplary embodiment of the present invention, FIG. 4 is a cross-sectional view along line IV-IV of FIG. 1 and FIG. 5 is a partial perspective view of an engine provided with a continuous variable valve duration apparatus according to an exemplary embodiment of the present invention.

Referring to FIG. 1 to FIG. 5, an engine 1 according to an exemplary embodiment of the present invention includes a continuous variable valve duration apparatus and the continuous variable valve duration apparatus is mounted to the engine 1 through a cam carrier 10.

In the drawings, the engine includes 4 cylinders 201, 202, 203 and 204, but is not limited thereto.

The continuous variable valve duration apparatus includes a camshaft 30, a cam device 70 on which a cam 71 or 72 is formed, of which the camshaft 30 is inserted thereto, of which a relative phase angle with respect to the camshaft 30 is variable, and the cam device 70 on which a cam key 74 is formed, an inside bracket 80 transmitting rotation of the camshaft 30 to the cam device 70 and on which a first and a second sliding hole 81 and 82 is formed respectively, a slider housing 90 in which the inside bracket 80 is rotatably inserted and of which relative position with respect to the camshaft 30 is variable, a controller 100 selectively changing the relative position of the slider housing 90, a cam pin 84 of which a cam key slot 83 for the cam key 74 to be slidably inserted thereto is formed and slidably inserted into the second sliding hole 82 and a slider pin 60 rotatably inserted into the first sliding hole 81 and slidably inserted into the camshaft 30.

The camshaft 30 may be an intake camshaft or an exhaust camshaft.

The cams 71 and 72 contact to open valve 200.

The slider pin 60 includes a pin body 62 slidably inserted into the camshaft 30 and a pin head 64 rotatably inserted into the first sliding hole 86, wherein the pin body 62 and the pin head 64 may be integrally or monolithically formed.

A camshaft hole 34 is formed at the camshaft 30, the pin body 62 of the slider pin 60 is slidably inserted into the camshaft hole 34 and the pin head 64 is rotatably inserted into the first sliding hole 86.

A camshaft oil hole 32 is formed in the camshaft 30 along a longitudinal direction thereof, a body oil hole 66 formed in the pin body 62 and configured to fluidically-communicate with the camshaft oil hole 32 and an oil groove 68 is formed in the pin head 64 and configured to fluidically-communicate with the body oil hole 66 through a communication hole 69 formed within the slider pin 60.

Lubricant supplied to the camshaft oil hole 32 may be smoothly supplied to the inside bracket 80 through the body oil hole 66, the communication hole 69 and the oil groove 68.

The cam device 70 includes a first cam portion 70*a* disposed corresponding to one cylinder, for example the first cylinder 201 and a second cam portion 70*b* disposed corresponding to the adjacent cylinder, for example the second cylinder 202 adjacent to the first cylinder 201. And the inside bracket 80 includes first and second inside brackets 80*a* and 80*b* configured to transmit rotation of the camshaft 30 to the first and second cam portions 70*a* and 70*b* respectively.

A double row bearing 92 is disposed within the slider housing 90 and is connected with the first and second inside brackets 80*a* and 80*b*. Thus, the first and second inside bracket 80*a* and 80*b* are disposed within one slider housing 90 and may be rotated without interruption due to the double row bearing 92.

Also, since the first and second inside brackets 80*a* and 80*b* are disposed within one slider housing 90, thus numbers of elements may be reduce, productivity may be improved and space for accommodating the continuous variable valve duration apparatus may be reduced.

In the drawings, the continuous variable valve duration apparatus according to various exemplary embodiments of the present invention may be applied to an engine with four cylinders, but is not limited thereto. The continuous variable valve duration apparatus according to various exemplary embodiments of the present invention may be applied to an engine with various cylinders. for example with six or more cylinders.

For easy comprehension, the continuous variable valve duration apparatus which is applied to a four-cylinder engine will be discussed.

The cam device 70 may include a first, a second, a third and a fourth cam portion 70*a*, 70*b*, 70*c* and 70*d* disposed corresponding to cylinders 201, 202, 203 and 204, the inside bracket 80 may include a first, a second, a third and a fourth inside bracket 80*a*, 80*b*, 80*c* and 80*d* configured to transmit rotation of the camshaft 30 to the first, the second, the third and the fourth cam portions 70*a*, 70*b*, 70*c* and 70*d* respectively, and the slider housing 90 may include a first slider housing 90*a* in which the first and the second inside bracket 80*a* and 80*b* are rotatable inserted and a second slider housing 90*b* in which the third and the fourth inside bracket 80*c* and 80*d* are rotatable inserted.

And double row bearings 92 may be disposed within the first and the second slider housing 90*a* and 90*b* respectively for rotatably supporting the first, the second, the third and the fourth inside bracket 80*a*, 80*b*, 80*c* and 80*d*.

In the exemplary embodiment of the present invention, the controller 100 may control phase angle (or duration) of the first, the second, the third and the fourth cam portion 70*a*, 70*b*, 70*c* and 70*d* by controlling positions of the two slider housings 90*a* and 90*b*, thus numbers of elements may be reduce, productivity may be improved and space for accommodating the continuous variable valve duration apparatus may be reduced.

The engine 1 according to an exemplary embodiment of the present invention further includes a support bracket 96 connecting the first slider housing 90*a* and the second slider housing 90*b* and on which a guide hole 98 is formed, a cam cap 40 rotatably supporting the camshaft 30 and a guide rod 94 mounted to the cam cap 40 and inserted into the guide hole 98 for guiding movement of the support bracket 96.

A control slot 93 is formed to each slider housing 90*a* and 90*b*, and the controller 100 includes an eccentric control shaft 102 inserted into the control slot, and a control motor 108 selectively rotating the eccentric control shaft 102 to change the relative position of the sliding housing 90. A worm wheel 104 is connected to the eccentric control shaft 102 and a worm gear 106 is connected to the control motor 108 and engaged with the worm wheel 104.

Each cam cap 40 includes a cam cap body 44 and a cam cap cover 46 connected with the cam cap body 44, and a shaft hole 42 for the eccentric control shaft 102 to be inserted thereto is formed between the cam cap body 44 and the cam cap cover 46. Since the eccentric control shaft 102 is inserted into the shaft hole 42, the eccentric control shaft 102 may be stably supported.

The cam is formed to each cam portion 70 as a pair 71 and 72, a cam cap connecting portion 76 is formed between the paired cams 71 and 72 of each cam portion 70 and thus the cam portion 70 may rotate stably.

Figure 6:
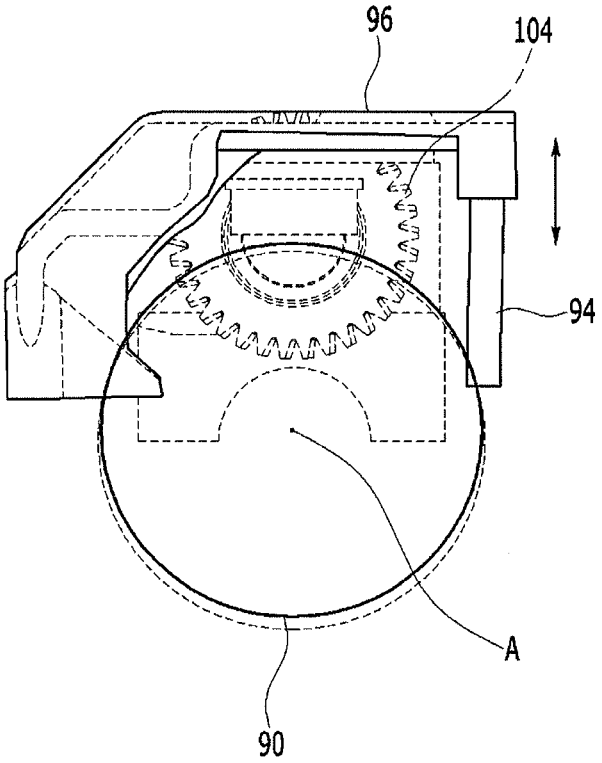
FIG. 6 is a drawing showing operation of a continuous variable valve duration apparatus according to an exemplary embodiment of the present invention.
Figure 7:
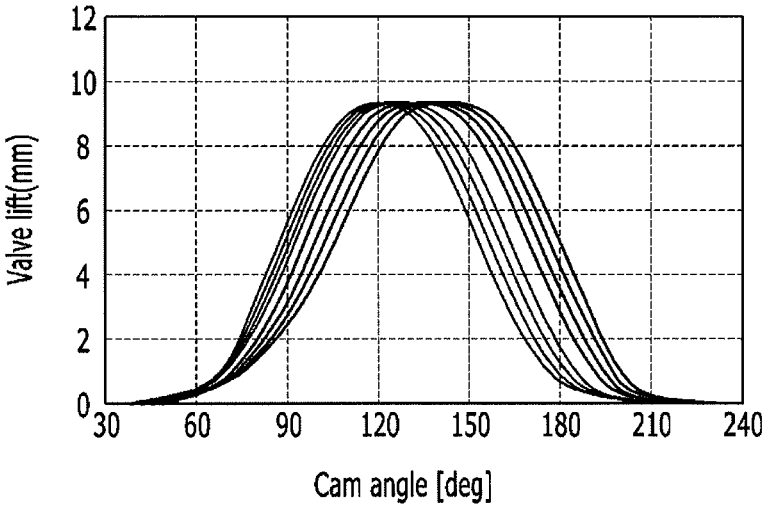
FIG. 7 is a graph of a valve profile of a continuous variable valve duration apparatus according to an exemplary embodiment of the present invention.

FIG. 6 is a drawing showing operation of a continuous variable valve duration apparatus according to an exemplary embodiment of the present invention and FIG. 7 is a graph of a valve profile of a continuous variable valve duration apparatus according to an exemplary embodiment of the present invention.

Referring to FIG. 1 to FIG. 7, operations of the continuous variable valve duration apparatus according to various exemplary embodiments of the present invention will be described.

According to engine operation states, an ECU (engine control device or electric control unit) transmits control signals to the motor 108 of the controller 100 to change the relative position of the slider housing 90. For example, the slider housing 90 may move upwards or downwards.

For example, as shown in FIG. 6 when the motor 108 rotates the eccentric control shaft 102 for the slider housing 90 to be moved, the rotation center of the inside bracket 80 moves upward with respect to the rotation center of the camshaft 30. Thus, angular acceleration of the cam portion 70 is changed so as that duration of the valve is changed.

A rotation center of the camshaft 30 is denoted as rA" in FIG. 6. When relative positions between the slider housing 90 and the inside bracket 80 are changed according to the operation of the control motor 108, a relative rotation centers the inside bracket 80 with respect to the camshaft 30 is changed.

While the slider pin 60 is rotated with the camshaft 30, the pin body 62 is slidable within the camshaft hole 34, the pin head 64 is rotatable within the first sliding hole 86, the cam pin 84 is rotatably within the second sliding hole 88 and the cam key 74 is slidable within the cam key slot 83. Thus, the relative rotation speed of the cams 71 and 73 with respect to the rotation speed of the camshaft 30 is changed.

As shown in FIG. 7, although maximum lift of the valve 200 is constant, however rotation speed of the cam 71 and 72 with respect to the rotation speed of the camshaft 30 is changed according to relative positions of the slider housing 90 so that closing and opening time of the valve 200 is changed. That is, duration of the valve 200 is changed.

While opening time of the valve 200 is constant, closing time of the valve 200 is changed in FIG. 7, it is not limited thereto. According to various mounting angle of the cams 71 and 72 and the valve 200, various contacting angles between cam lobe of the cams 71 and 72 and the valve 200 and so on, various valve duration may be performed.

Figure 8:
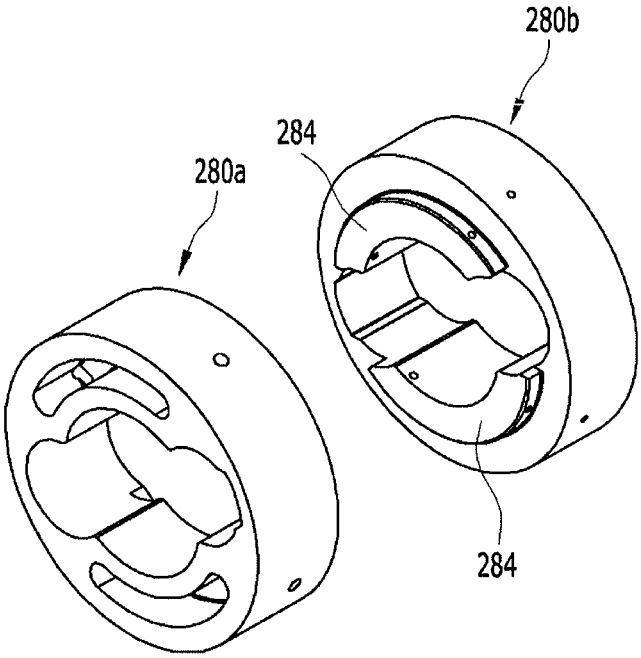
FIG. 8 and FIG. 9 are drawings showing an inside bracket according to a modified exemplary embodiment of the present invention.
Figure 9:
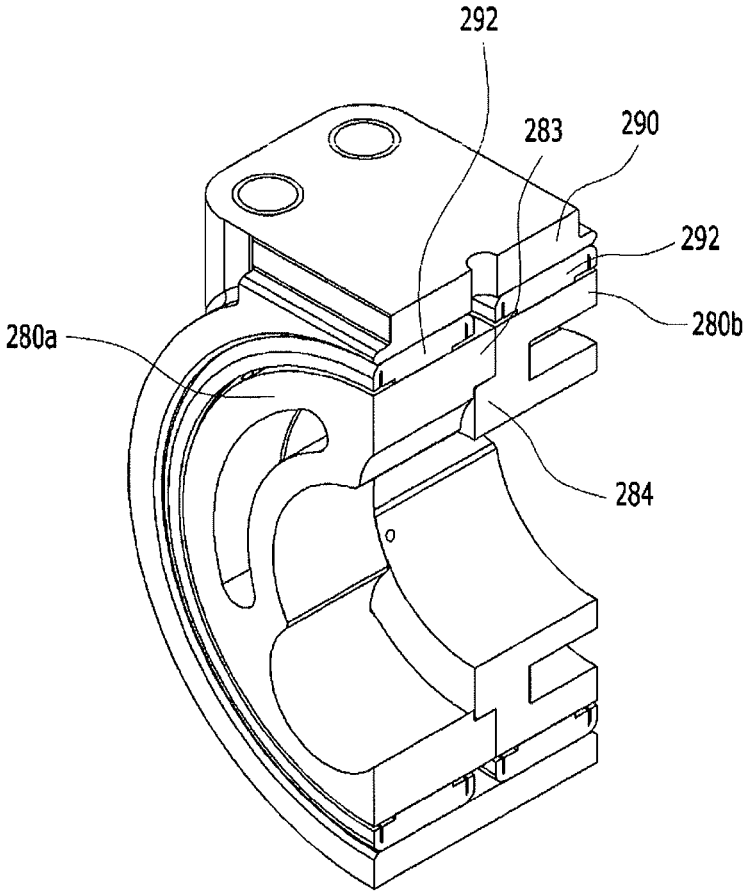

FIG. 8 and FIG. 9 are drawings showing an inside bracket according to a modified exemplary embodiment of the present invention.

Referring to FIG. 8 and FIG. 9, a bearing 292, for example a double row bearing may be disposed within a slider housing 290 and a first inside bracket 280*a* and a second inside bracket 280*b* may be connected to each other. For example, a first inside bracket connector 283 and a second inside bracket connector 284 are formed at the first inside bracket 280*a* and the second inside bracket 280*b* respectively, and the first inside bracket connector 283 and second inside bracket connector 284 are connected.

In the drawing, the first inside bracket connector 283 and the second inside bracket connector 284 are formed as convex In the case that the first inside bracket 280*a* and the second inside bracket 280*b* are connected, looseness or vibration due to manufacturing tolerances of the bearing, the inside bracket, the lifter and so on may be reduced.

Although it is not shown in the drawings, however, the third inside bracket and the fourth inside bracket may be connected for the third inside bracket and the fourth inside bracket to be rotated stably.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

Since the body oil hole 66 and the oil groove 68 are formed at the slider pin 60, lubricant may be smoothly supplied to rotation elements including the inside brackets and so on.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration apparatus comprising:

a camshaft;

a cam device on which a cam is formed, of which the camshaft is inserted thereto, of which a relative phase angle with respect to the camshaft is variable, and the cam device on which a cam key is formed;

an inside bracket transmitting rotation of the camshaft to the cam device and on which a first slide opening and a second sliding opening are formed respectively;

a slider housing in which the inside bracket is rotatably inserted and of which a relative position with respect to the camshaft is variable;

a controller selectively changing the relative position of the slider housing;

a cam pin of which a cam key opening for the cam key to be slidably inserted thereto is formed and slidably inserted into the second sliding opening; and a slider pin rotatably inserted into the first sliding opening and slidably inserted into the camshaft.

2. The continuous variable valve duration apparatus of claim 1, wherein the slider pin includes:

a pin body slidably inserted into the camshaft; and a pin head rotatably inserted into the first sliding opening, wherein the pin body and the pin head are integrally or monolithically formed.

3. The continuous variable valve duration apparatus of claim 2, wherein a camshaft oil opening is formed in the camshaft along a longitudinal direction thereof, a body oil opening is formed in the pin body and configured to fluidically-communicate with the camshaft oil opening and an oil groove is formed in the pin head and configured to fluidically-communicate with the body oil opening.

4. The continuous variable valve duration apparatus of claim 1, wherein the cam device includes a first cam portion disposed corresponding to a first cylinder and a second cam portion disposed corresponding to a second cylinder adjacent to the first cylinder, and the inside bracket includes first and second inside brackets configured to transmit rotation of the camshaft to the first cam portion and the second cam portion respectively.

5. The continuous variable valve duration apparatus of claim 4, further including a bearing disposed within the lifter and is supports the first inside bracket and the second inside bracket.

6. The continuous variable valve duration apparatus of claim 4, wherein the first inside bracket and the second inside bracket are connected to each other.

7. The continuous variable valve duration apparatus of claim 1, wherein the cam device includes a first cam portion, a second cam portion, a third cam portion and a fourth cam portion disposed corresponding cylinders, the inside bracket includes a first inside bracket, a second inside bracket, a third inside bracket and a fourth inside bracket configured to transmit rotation of the camshaft to the first cam portion, the second cam portion, the third cam portion and the fourth cam portion, respectively, and the slider housing includes a first slider housing in which the first and the second inside brackets are rotatable inserted and a second slider housing in which the third and the fourth inside bracket are rotatable inserted.

8. The continuous variable valve duration apparatus of claim 7, further including double row bearings disposed within the first slider housing and the second slider housing respectively for rotatably supporting the first inside bracket, the second inside bracket, the third inside bracket and the fourth inside bracket.

9. The continuous variable valve duration apparatus of claim 7, wherein the first inside bracket and the second inside bracket are connected to each other, and the third inside bracket and the fourth inside bracket are connected to each other.

10. An engine comprising:

a camshaft;

a cam device on which a cam is formed, of which the camshaft is inserted thereto, of which a relative phase angle with respect to the camshaft is variable, and the cam device on which a cam key is formed;

an inside bracket transmitting rotation of the camshaft to the cam device and on which a first slide opening and a second sliding opening are formed respectively;

a slider housing in which the inside bracket is rotatably inserted and of which a relative position with respect to the camshaft is variable;

a controller selectively changing the relative position of the slider housing;

a cam pin of which a cam key opening for the cam key to be slidably inserted thereto is formed and slidably inserted into the second sliding opening; and a slider pin rotatably inserted into the first sliding opening and slidably inserted into the camshaft.

11. The engine of claim 10, wherein the slider pin includes:

a pin body slidably inserted into the camshaft; and a pin head rotatably inserted into the first sliding opening, wherein the pin body and the pin head are integrally or monolithically formed.

12. The engine of claim 11, wherein a camshaft oil opening is formed in the camshaft along a longitudinal direction thereof, a body oil opening is formed in the pin body and configured to fluidically-communicate with the camshaft oil opening and an oil groove is formed in the pin head and configured to fluidically-communicate with the body oil opening.

13. The engine of claim 10, wherein wherein the cam device includes a first cam portion disposed corresponding to a first cylinder and a second cam portion disposed corresponding to a second cylinder adjacent to the first cylinder, and the inside bracket includes first and second inside brackets configured to transmit rotation of the camshaft to the first cam portion and the second cam portion respectively.

14. The engine of claim 13, further including a bearing disposed within the lifter and is supports the first inside bracket and the second bracket.

15. The engine of claim 13, wherein the first inside bracket and the second inside bracket are connected to each other.

16. The engine of claim 10, wherein the cam device includes a first cam portion, a second cam portion, a third cam portion and a fourth cam portion disposed corresponding cylinders, the inside bracket includes a first inside bracket, a second inside bracket, a third inside bracket and a fourth inside bracket configured to transmit rotation of the camshaft to the first cam portion, the second cam portion, the third cam portion and the fourth cam portion respectively and the slider housing includes a first slider housing in which the first inside bracket and the second inside bracket are rotatable inserted and a second slider housing in which the third inside bracket and the fourth inside bracket are rotatable inserted.

17. The engine of claim 16, further including double row bearings disposed within the first slider housing and the second slider housing respectively for rotatably supporting the first inside bracket, the second inside bracket, the third inside bracket and the fourth inside bracket t.

18. The engine of claim 16, wherein the first inside bracket and the second inside bracket are connected, and the third inside bracket and the fourth inside bracket are connected.

19. The engine of claim 16, further including:

a support bracket connecting the first slider housing and the second slider housing and on which a guide opening is formed;

a cam cap rotatably supporting the camshaft; and a guide rod mounted to the cam cap and inserted into the guide opening for guiding movement of the support bracket.

20. The engine of claim 16, wherein a control opening is formed at the first slider housing and second slider housing respectively, and the controller includes:

an eccentric control shaft inserted into the control openings; and a control actuator rotating the eccentric control shaft for controlling a relative position of the sliding housing.

21. The engine of claim 20, wherein a shaft opening is formed on each cam cap for the eccentric control shaft to be inserted therein.

* * * * *